United States Patent [19]

Roerig et al.

[11] Patent Number: 4,673,461

[45] Date of Patent: Jun. 16, 1987

[54] ENCLOSED SHOE PRESS WITH FLEXIBLE END CONNECTIONS FOR ITS ANNULAR BELT

[75] Inventors: Arnold J. Roerig, Beloit; Steven C. Shockley, Clinton, both of Wis.

[73] Assignee: Beloit Corporation, Beloit, Wis.

[21] Appl. No.: 801,317

[22] Filed: Nov. 25, 1985

[51] Int. Cl.[4] ..... D21F 3/02

[52] U.S. Cl. ..... 162/205; 100/153; 162/358; 162/361

[58] Field of Search ..... 162/205, 358, 361, 93 RP, 162/272; 29/113 AD, 116 AD; 100/118, 153, 38

[56] References Cited

U.S. PATENT DOCUMENTS

| | | | |
|---|---|---|---|
| 3,269,893 | 8/1966 | Rojecki | 162/358 |
| 3,804,707 | 4/1974 | Mohr et al. | 162/358 |
| 4,201,624 | 5/1980 | Mohr et al. | 162/305 |
| 4,287,021 | 9/1981 | Justus et al. | 162/358 |
| 4,555,305 | 11/1985 | Steiner et al. | 162/361 |
| 4,563,245 | 1/1986 | Wanke et al. | 162/361 |
| 4,584,059 | 4/1986 | Schiel et al. | 162/358 |

FOREIGN PATENT DOCUMENTS

| | | |
|---|---|---|
| 3239954A1 | 5/1984 | Fed. Rep. of Germany . |
| 3317457A1 | 11/1984 | Fed. Rep. of Germany . |
| 3317455A1 | 11/1984 | Fed. Rep. of Germany . |
| 3317456A1 | 11/1984 | Fed. Rep. of Germany . |

*Primary Examiner*—S. Leon Bashore
*Assistant Examiner*—K. M. Hastings
*Attorney, Agent, or Firm*—Dirk J. Veneman; Raymond W. Campbell; David J. Archer

[57] ABSTRACT

An extended nip press for removing water from a traveling web in a paper machine including a press roll with an elongate shoe having a concave surface facing the roll and forming an extended nip therebetween with the shoe pressed to the roll and mounted to accommodate movement to form a wedge of lubricant between the shoe and a belt with the ends of the belt closed by end walls to contain lubricant within the belt and a flexible radial connection between the end walls and the ends of the belt so that the belt will follow the curvature of the nip beyond the ends of the shoe and will flex only in a single plane of the nip.

11 Claims, 6 Drawing Figures

ENCLOSED SHOE PRESS WITH FLEXIBLE END CONNECTIONS FOR ITS ANNULAR BELT

BACKGROUND OF THE INVENTION

The present invention relates to improvements in presses for mechanically pressing water from a traveling web in a paper machine, and more particularly of the press of the type known as an extended nip press. In an extended nip press, the length of a single nip in the machine direction extends substantially longer than the nip of a conventional type formed between two mating rolls. More particularly, the invention relates to improvements in means for containing lubricant which is used to provide a wedge of lubricating film between the shoe and belt in an extended nip press of the type which employs a concave shoe urged toward a supporting roll to form a nip with the shoe urged toward the nip and the shoe supported in a manner so that it will be self-positioning to maintain the wedge of lubricant.

Extended nip presses of this type have been formed in various arrangements with one type of arrangement disclosed and illustrated in Justus U.S. Pat. No. 3,783,097. In a press of this type in a high speed pressing operation, oil is employed as a lubricant between the shoe and belt. Oil will form a wedge that will not break down under normal operating speeds. This type of press is particularly advantageous in extending the time to which a sheet of paper is exposed to pressing pressure within the nip. It is also advantageous in that the invention of this press permits control of the pressure profile within the nip. Optimum pressing and variations in pressure profile can be attained by varying the location of the shoe relative to its support and by changing the curvature of the shoe. Advantages in pressing with this type of press, known as high impulse pressing, include substantially increased dewatering as contrasted with a two roll press, improvement in paper strength and uniformity of the paper web in a cross-machine direction. The combination of these advantages and the magnitude of the advantages make this advance in the art of this particular type of extended nip press of the Justus U.S. Pat. No. 3,783,097 one of the outstanding and most important advances in the papermaking field in many years.

In operation of this type of shoe press, at high operating speeds, a mist of oil tends to be generated as the belt passes the shoe and develops the wedge of lubricant. Various efforts have been made to control the oil and contain it. One arrangement has been to provide seals around the shoe, and an example of this is illustrated in U.S. Pat. No. 4,398,997, Cronin.

Another example of an approach in containing the oil has been to place end walls in a looped annular belt, and this is being done commercially by Voith GmbH of Heidenheim, Germany. The Voith arrangement causes considerable problems in that the end walls are circular with the belt following its natural circular looped shape. The belt must curve in an arc opposite to the direction of the looped shape while passing through the nip formed between the shoe and the roll. At the ends of the nip beyond the end of the shoe, the belt is held by the circular end walls and is compelled to flex in a double plane direction. That is, the ends of the belt tend to continue in the natural circular shape and are held in this natural circular shape by the end walls which are rigidly connected to the end of the belt. This causes continual flexure of the belt in a double plane opposite the end of the shoe and incurs failure of the belt by rupturing and breaking due to the continual double plane flexing.

It is accordingly an object of the present invention to provide a method and apparatus for containing lubricant within a looped belt of a shoe type press without shortening the life of the belt due to its flexing in a double plane at the ends of the nip.

A further object of the invention is to provide an improved shoe type press utilizing an improved method and apparatus for containing oil within a looped belt of the press by providing an end wall which is connected to the belt in such a manner that it permits the belt to follow the single plane of curvature of the nip beyond the ends of the nip thereby avoiding the disadvantages of an end wall structure such as that employed by the aformentioned Voith arrangement.

Other objects, advantages and features, as well as equivalent methods and structures which are intended to be covered herein, will become more apparent with the teaching of the principles of the invention in connection with the disclosure of the preferred embodiments thereof in the specification, claims and drawings, in which:

DESCRIPTION OF THE PREFERRED EMBODIMENTS

Figure 1:
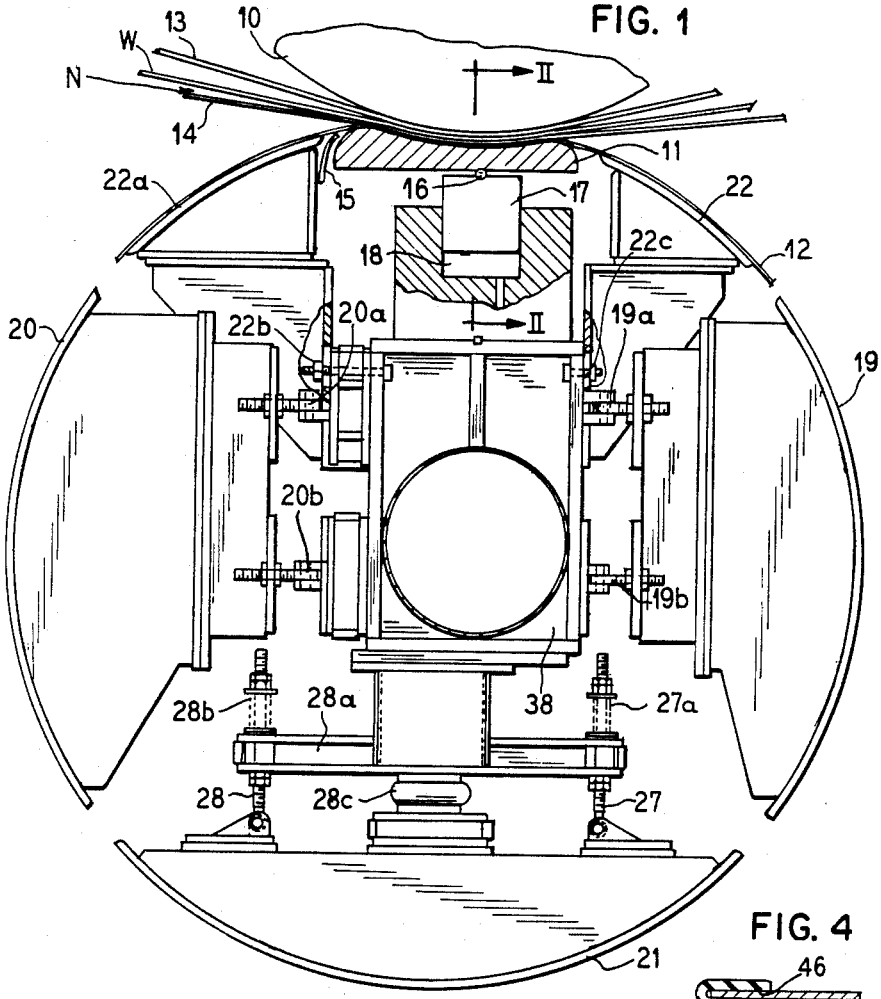
FIG. 1 is a vertical sectional view taken at right angles to an axis of a shoe type extended nip press.
Figure 2:
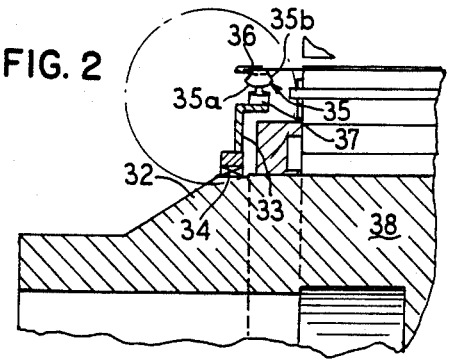
FIG. 2 is a fragmentary vertical sectional view taken substantially along line II—II of FIG. 1.
Figure 3:
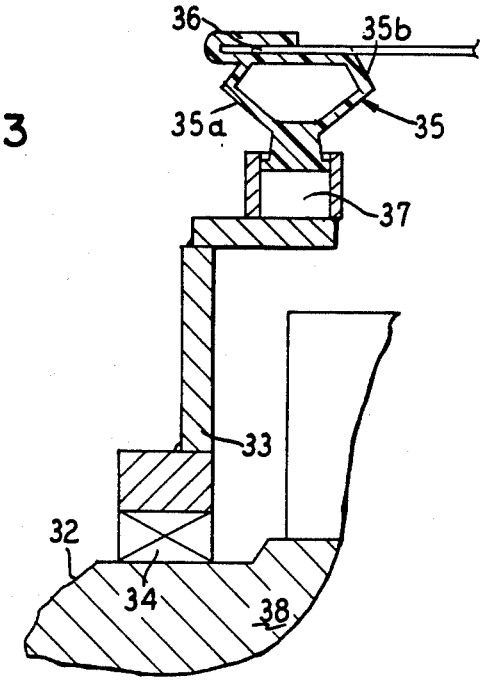
FIG. 3 is an enlarged fragmentary view taken substantially in the area indicated in FIG. 2.

As shown in FIGS. 1 through 3, the mechanism includes a press roll 10 which may be a solid roll or a roll having deflection control means such as provided by a hollow roll shell with a controllable support therein opposite the nip. The roll 10 forms a nip with a shoe 11. The shoe 11 is provided with a concave surface facing the roll and is mounted so that as it is urged toward the roll, a press nip N is formed therebetween which subjects a web of paper W passing through the nip to a pressing pressure over an extended length of time. A looped belt 12 passes through the nip between the shoe 11 and roll 10. A hydrodynamic wedge of fluid builds up between the belt and the shoe to transmit pressure to the web passing through the nip and press water from the web. By control of the design and loading of the shoe, the pressure profile to which the web is subjected in passing through the nip can be controlled. Preferably, the pressure profile should provide for a gradual increase in pressure in the nip sufficient to build up to a desired nip pressure as rapidly as possible without causing crushing or dislocation of the fibers. As an optimum pressure is reached, this pressure is held for a period of time until near the end of the shoe at which a rapid pressure drop-off is permitted. The rapid drop-off aids in preventing rewetting of the web as it leaves the nip. This pressure profile is taught by the method disclosed in U.S. Pat. No. 3,808,092, Busker.

Means are provided for receiving water pressed from the web in the form of felts 13 and 14 which sandwich the web therebetween. It may also be desired to provide grooves in the surface of the roll 10 and in the surface of the belt 12 to aid in permitting the water to pass into the felts and to be retained thereby.

The shoe is supported and is urged toward the nip to provide a pressing force. For this purpose, the shoe is tiltably or pivotally supported such as on a roll pin 16 seated in a downwardly facing groove in the shoe 11 and an upwardly facing groove in a piston 17. The piston is urged upwardly by fluid pressure beneath the piston in a chamber 18 which is in the form of an elongate slot or well slidably receiving the piston extending the full width of the machine beneath the shoe.

While the drawing shows a preferred form, it will be understood that the shoe may be supported in various ways such as to be tiltable and be self-positionable as it is urged up toward the backing roll 10. By permitting the piston to be self-positionable and a slave to the backing roll, the wedge of lubricating fluid is permitted to be built up in the nip without breaking down which would cause consequent scuffing of the inner surface of the belt 12. Lubricating fluid, preferably in the form of oil, is supplied to a relieved nose at the leading end of the piston through a lubricant supply 15.

As will be appreciated by those versed in the art of papermaking, the cross-machine width of the nip depends upon the width of the machine desired by the papermaker and the roll 10, shoe 11 and its support mechanism will extend for the full width of the machine so as to continually press a wide web W passing through the nip.

The belt is structured in the form of a continuous loop. The loop is permitted to travel in operation in its natural shape as shown and taught by U.S. Pat. No. 4,287,021, Justus et al and its reissue Re. 31,923. In accordance with the teachings of this Justus et al patent, guide means are provided for the belt which support it and guide it during start-up of the machine and which provide a support for the belt when the belt encounters instability during operation. The looped belt is of considerable weight and fluttering or instablity can occur at high speeds so that guides are provided within the belt to again stabilize the belt if this instability should occur during normal operation. For example, if the belt should start fluttering such as due to the disturbances outside the belt or unexpected unequal distribution of oil within the belt, the fluttering will be dampened and corrected so that the belt can return to traveling in its natural free form unsupported shape where there is a very small space between the guide and belt.

These guide means for the belt are shown in the form of curved side guides 19 and 20, and upper guides 22 and **22*a* and a lower guide 21**. While guides are shown as being of some appreciable length, shorter guides, or guides with greater spacing therebetween or even axially extended guide bars with rounded ends may be used with the guides positioned so that they lie on a circle defining the natural free form running shape of the belt.

The belt guides 19 and 20 are supported for adjustment so that they can be adjusted to provide a very small gap between the outer smooth surfaces of the guides and the belt during normal free form operation. The guides are carried on the central beam 38 and are mounted so as to be adjustable in position to maintain the very small gap between the inner surface of the belt and the outer smooth surface of the guides during the natural free form operation. The lower shoe 21 is supported on pins 27 and 28 carried on a crossbar **28*a* on the beam. The vertical pins extend through openings in the crossbar and have springs 27*a* and 28*b* urging the pins in an upwardly direction. An air inflatable bellows 28*c* is located between the beam and shoe and by controlling the inflation in the bellows through an air connection, not shown, the position of the shoe 21** relative to the inner surface of the belt can be adjusted.

The side shoe 20 is mounted on brackets **20*a* and 20*b* on the beam 38. The side shoe 19 is mounted on brackets 19*a* and 19*b* on the beam 38. Brackets 19*a*, 19*b*, 20*a* and 20*b* permit adjustment to control the lateral position of the shoes 19 and 20** so that they can be positioned correctly relative to the free form of the inner surface of the belt.

The upper shoes 22 and **22*a* are adjustably supported on brackets with bolts 22*b* and 22*c* on the beam so that they can be accurately adjusted and located relative to the free form shape of the belt. In other words, the lower shoe 21, the side shoes 19 and 20, and the upper shoes 22 and 22*a*** are all adjusted so as to provide a continual support for the belt. The shoes are adjusted so that a very small gap exists between their outer smooth surface and the belt as the belt runs in its free form during operation. Minor disturbances in operation can, of course, disturb the free form of the belt. Such disturbances as change in stock, change in stock temperature, wads passing through the nip, and unevenness in the thickness of the felts will disturb the perfection of the travel of the belt in its ideal free form. The guide shoes, however, will immediately stablize the belt so that it returns to its free form. It will be apparent to those versed in the art that while the shoes have a surface of substantial length, much shorter shoes could be used and in fact, even smooth surfaced longitudinally extending bars may be employed inasmuch as they will function to smooth out disturbances of the belt when such occur. For example, ripples in the surface of the belt caused by disturbing forces will cause the belt to immediately contact the guide shoes which will smooth out such disturbances and cause the belt to resume its operation in its free form which is approximately circular in shape. When the belt is disturbed from its free form so that it engages the guide shoes, a slight drag will occur due to the inner surface of the belt contacting the outer surface of the shoes, but because the disturbance or deviation of the belt from its free form is quickly corrected, this drag can be tolerated.

In operation as the machine is started up, drive means, not shown, is provided for the backup roll 10 and its frictional contact through the felts 13 and 14 drives the belt. The shoe is then loaded up against the belt and the lubricating oil delivered through the supplies 15 provides for the build-up of a wedge of oil between the shoe and the belt. At start-up, oil which may be left within the belt is pumped out from within the belt by a line having an intake near the lower shoe 21. This line continues to remove extra oil from within the belt during operation. As the belt starts up, it is guided by the smooth outer surfaces of the shoes 19, 20, 21, 22 and **22*a*** and as it attains operating speed, centrifugal force causes it to attain its natural free form shape so that it runs unsupported by the guides.

Figure 5:
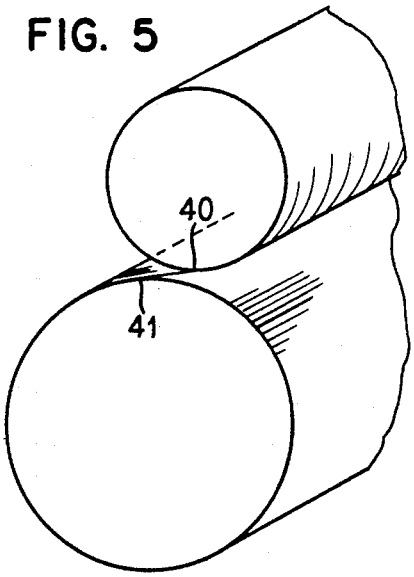
FIG. 5 is a schematic illustration of the effect of devices heretofore used which forced flexing in a double plane direction of the belt opposite the ends of the nip.

A mist of oil is generated within the belt due to the high relative speed of travel of the belt over the shoe. For containing this mist within the belt, end walls 33 are provided at the axial ends of the looped annular belt. The beam 38 has end hubs 32 extending beyond the end walls, and the end walls are positioned to be supported coaxial on the circular end hubs 32 by having annular bearings 34 between the end walls and the hubs 32 of the beam. In structures heretofore provided, circular end walls have been connected to the annular ends of the belt and such walls have been the same diameter as the belt such that they cause the belt to retain a circular shape at the ends beyond the end of the nip. These end walls have taken the form of plates with clamping rings which are bolted to the circular belt. With this heretofore known structure, as the belt passes through the nip, it must curve in a direction opposite of its natural curvature such as shown at 40 in FIG. 5. This will cause a flexure of the belt in a double plane direction causing it to bend upwardly at the ends to retain the circular shape shown at 41 of the end wall while inwardly of the end wall, the belt flexes in a concave arc to follow the curvature of the nip illustrated at 40. This double plane flexure causes considerable stress on the belt particularly at high operating speeds, such as on the order of 2,000 to 4,000 feet per minute, causing eventual premature failure of the belt. The belts are expensive and the required shut-down time of the machine to change belts incurs considerable cost.

Figure 6:
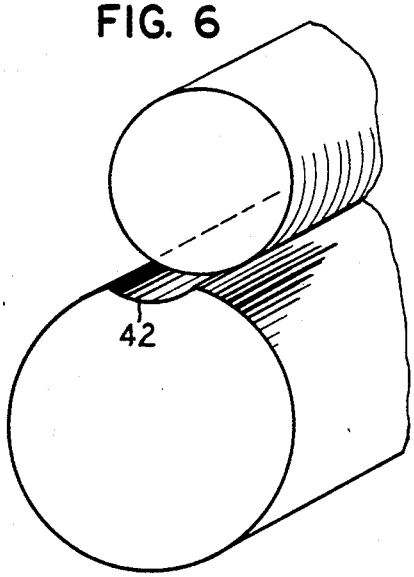
FIG. 6 is an illustration similar to FIG. 5 but showing the resultant single plane flexing attained utilizing the advantages of the present invention.

With the arrangement provided by the present invention, the belt need to flex only in a single plane as shown in FIG. 6. Essentially no constraint is placed on the ends of the belt in a radial direction so that it may curve in a concave curve all the way to the end in the manner shown in FIG. 6 which may be referred to as single plane flexure. It will be apparent that this results in considerable less stress on the belt in the area at the ends of the nip.

This is accomplished by providing seals at the ends of the endless belt which permit the belt to freely flex in the plane of the roll beyond the lateral ends of the shoe. The end walls which are provided offer substantially no resistance to the belt flexing in this roll plane while still maintaining the integrity of the closure at the end of the belt. In a preferred form, an annular end wall 33 is provided supported on bearings 34 mounted on the hub 32 of the beam. This end wall is of a diameter less than the belt and is connected to the ends of the belt by a flexible yieldable connection between the outer edge of the end wall and the outer end of the belt. The soft yieldable connector 35, FIGS. 2 and 3, maintains the oil mist integrity of the end wall and yet does not offer resistance to the belt following the arc of flexure in the nip. In one form the seal or connector 35 has a double accordion wall with an outer wall shown at 35*a* and an inner wall at 35*b*. The inner edges of the wall are connected at 37 to the end wall 33 and at their outer edges 36 to the belt.

Figure 4:
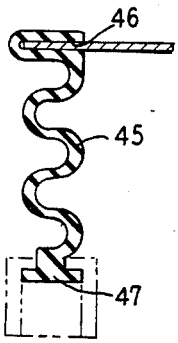
FIG. 4 is an enlarged fragmentary view similar to FIG. 3 illustrating an alternate form of flexible end wall.

FIG. 4 illustrates another form of connector 45 which is an undulated shaped flexible wall which extends from the outer edge of the end wall 33 to the outer edge of the belt 12. The flexible annular connector 45 may be provided with an inwardly facing groove 46 so as to receive the end of the belt and may be clamped thereto such as being sewn to draw the sides of the groove 46 tightly against the belt 12. The inner radial edge of the connector 45 may be provided with a T-shaped base 47 for securing to the end wall. If desired, the connector 45 may be of substantial radial depth so that it connects directly to the bearing 34 which rides on the hub 32.

As will be recognized from the foregoing description and disclosure, various forms of rotating annular connectors or seal may be employed which provide a soft flexible mist impervious connection. The radial depth of the connectors must be sufficient to permit flexing of the belt to follow the curvature of the nip as illustrated in FIG. 6. The radius of the outer edge of the circular end walls is at least as small as the radius from the center of the belt to the working face of the press shoe and preferably smaller. The total radius of the end wall and connector is equal to the radius of the belt. It is contemplated that the entire end wall may be made flexible but in the preferred arrangement, a more rigid end wall is used with a flexible annular outer connector portion.

Thus in operation, as the press operates at a normal operating speed, mist formed within the looped belt will be retained therein by the end wall and the rotating belt seal. Yet, during rotation, the belt will be permitted to flex and follow the curvature of the nip, changing its arc of curvature from the natural shape to the nip shape while passing through the nip. At the entering end of the nip, the belt begins to follow the curvature of the nip and at the trailing end of the shoe, the belt again follows the natural shape. This occurs over the entire width of the belt beyond the nip end and the sole flexure which the belt must encounter is in the single plane. This permits design and construction for maximum strength in the expected single plane of flexure.

The improved stable travel of the belt substantially enhances the operating life of the belt eliminating the need for frequent replacement. Thus, the advantages of the shoe type extended nip press can be attained and the speed of operation, viscosity of oil, and press nip pressures can be chosen solely for optimum performance and without concern to the possible generation of an oil mist. This also permits elimination of mist preventing seals around the shoe and permits the use of a looped belt, and the diminished power requirement in permitting the belt to travel during operation at its natural free form shape, without concern as to the escape of oil mist.

Thus, it will be seen that there has been provided an improved extended nip press structure which attains the advantages and objectives herein set forth and modifications and variations within the scope of the invention will become apparent to those versed in the art from the foregoing description.

We claim as our invention:

1. In an extended nip press for removing water from a traveling web in a paper machine, comprising in combination:

a rotatable press roll;

an elongate shoe having a concave pressing surface facing the roll so that a dewatering press nip is formed between the shoe and roll;

means for applying a force urging the shoe towards the roll so that a web is subjected to dewatering pressure in the nip;

a continuous looped annular belt passing through the nip and extending beyond the lateral ends of the shoe;

means for supplying lubricant to the leading edge of the shoe to build up a wedge of lubricant between the shoe and belt;

end walls on the axial ends of said belt for containing lubricant within the belt; and a flexible annular connector joining the said end wall to the belt and having a radial dimension sufficient so that the belt flexes and conforms to the curvature of the shoe beyond the lateral ends of the shoe with said connectors absorbing the relative deflection between said end wall and belt.

2. In an extended nip press for removing water from a traveling web in a paper machine constructed in accordance with claim 1, the combination wherein:

said annular connector is formed of a soft flexible material having its radial dimension substantially equal to the space between the outer edges of the end wall and the belt.

3. In an extended nip press wherein a continuous looped annular belt passes through a nip formed between a concave shoe and roll, said looped belt extending beyond the lateral ends of the shoe, with the shoe urged towards the roll in a manner to permit the shoe to tilt and form a wedge of lubricant between the shoe and the belt, the improvement comprising:

end walls at the axial ends of the looped belt having sufficient flexibility to accommodate the belt following a single plane of the curved nip between the roll and shoe and structured so that the belt flexes substantially only in the single plane of the nip beyond the lateral ends of the shoe and follows the same curvature beyond the lateral ends of the shoe as it follows through the nip.

4. In an extended nip press wherein a continuous looped annular belt passes through a nip formed between a concave shoe and roll, said looped belt extending beyond the lateral ends of the shoe, with the shoe urged towards the roll in a manner to permit the shoe to tilt and form a wedge of lubricant between the shoe and the belt, the improvement comprising:

annular end walls for the axial ends of the belt beyond the lateral ends of the shoe for containing lubricant within the belt;

an annular connection between the end walls and the belt having substantial flexibility in the radial plane of the end walls and having a radial dimension sufficient so that the belt follows the same curvature beyond the lateral ends of the shoe as it follows through the nip and flexes in a single plane at the lateral ends of the nip.

5. In an extended nip press constructed in accordance with claim 4:

wherein said connection is formed of a soft flexible material having its radial dimension greater than the space between the outer edges of the end walls and the belt for accommodating flexing of the connection.

6. In an extended nip press constructed in accordance with claim 4:

wherein the connection is formed of a double-walled material having its radial dimension greater than the space between the outer edges of the end walls and the belt so as to facilitate the flexure of the belt beyond the lateral ends of the shoe with the same curvature in a single plane as the belt follows within the nip.

7. In an extended nip press constructed in accordance with claim 4:

wherein said connection has an accordion fold in the radial direction to permit flexure and permit the belt to follow its curvature in a single plane beyond the lateral ends of the shoe the same as the curvature within the nip.

8. In an extended nip press wherein a continuous looped annular belt passes through a nip formed between a concave shoe and a roll, said looped belt extending beyond the lateral ends of the shoe, with the shoe urged towards the roll in a manner to permit the shoe to tilt and form a wedge of lubricant between the shoe and the belt, the improvement comprising:

annular end walls for the axial ends of the belt beyond the lateral ends of the shoe for containing lubricant within the belt;

an annular connection between the end walls and the belt having substantial flexibility in the radial plane of the end walls and having a radial dimension sufficient so that the belt follows the same curvature beyond the lateral ends of the shoe as it follows through the nip and flexes in a single plane at the lateral ends of the nip; and rotatable bearings between the end walls and a shaft centrally located relative to the belt.

9. The method of containing lubricant within a continuous looped annular belt passing through a lubricated extended nip between a concave shoe and a roll with the shoe pressed to the roll to dewater a web passing through the nip, the belt extending beyond the lateral ends of the shoe and roll, which comprises the steps of:

sealing off the axial ends of the belt with an end wall connected to the axial ends of the belt, said end walls being structured so that the belt flexes in the curvature of the plane of the roll beyond the lateral ends of the shoe and roll by offering substantially no resistance to the belt flexing in the roll plane while maintaining the integrity of the connection between the end wall and the belt.

10. The method of containing lubricant within a continuous looped annular belt passing through a lubricated extended nip between a concave shoe and a roll with the shoe pressed to the roll to dewater a web passing through the nip, the belt extending beyond the lateral ends of the shoe, and wherein the belt is substantially unsupported following its natural annular shape in its travel from the trailing edge of the shoe to the leading edge, which comprises the steps of:

closing off the axial ends of the belt in a manner so that the axial ends of the belt are substantially unrestrained so that the belt flexes following the plane of curvature of the roll and shoe beyond the lateral ends of the shoe while passing through the nip.

11. The method of containing lubricant within a continuous looped annular belt passing through a lubricated extended nip between a concave shoe and a roll with the shoe pressed to the roll to dewater a web passing through the nip, said belt extending beyond the lateral ends of the shoe, which comprises the steps of:

providing end walls for closing off the axial ends of the belt;

and joining the end walls with the axial ends of the belt with an annular connector offering low resistance to flexing of the belt following the natural curvature of the nip at the lateral ends of the nip said connector having a radial depth sufficient so that the belt flexes only in a single plane beyond the lateral ends of the shoe and follows the curvature of the nip.

* * * * *